US008821611B2

(12) United States Patent
Jacobsen et al.

(10) Patent No.: US 8,821,611 B2
(45) Date of Patent: Sep. 2, 2014

(54) TITANIUM BORIDE

(71) Applicant: Cristal Metals Inc., Hunt Valley, MD (US)

(72) Inventors: Lance Jacobsen, Minooka, IL (US); Adam Benish

(73) Assignee: Cristal Metals Inc., Hunt Valley, MD (US)

( * ) Notice: Subject to any disclaimer, the term of this patent is extended or adjusted under 35 U.S.C. 154(b) by 0 days.

(21) Appl. No.: 13/706,946

(22) Filed: Dec. 6, 2012

(65) Prior Publication Data

US 2013/0343945 A1 Dec. 26, 2013

Related U.S. Application Data

(63) Continuation of application No. 11/544,820, filed on Oct. 6, 2006, now abandoned.

(60) Provisional application No. 60/724,166, filed on Oct. 6, 2005.

(51) Int. Cl.
*B22F 9/24* (2006.01)
*C22C 14/00* (2006.01)

(52) U.S. Cl.
USPC ..... 75/351; 75/343; 75/367; 75/617; 75/619

(58) Field of Classification Search
CPC ..... B22F 9/28
See application file for complete search history.

(56) References Cited

U.S. PATENT DOCUMENTS

| | | | |
|---|---|---|---|
| 1,771,928 | A | 7/1930 | Jung |
| 2,205,854 | A | 6/1940 | Kroll |
| 2,607,675 | A | 8/1952 | Gross |
| 2,647,826 | A | 8/1953 | Jordan |
| 2,816,828 | A | 12/1957 | Benedict et al. |
| 2,823,991 | A | 2/1958 | Kamlet |
| 2,827,371 | A | 3/1958 | Quin |
| 2,835,567 | A | 5/1958 | Wilcox |
| 2,846,303 | A | 8/1958 | Keller et al. |
| 2,846,304 | A | 8/1958 | Keller et al. |
| 2,882,143 | A | 4/1959 | Schmidt |
| 2,882,144 | A | 4/1959 | Follows et al. |
| 2,890,112 | A | 6/1959 | Winter |
| 2,895,823 | A | 7/1959 | Lynskey |
| 2,915,382 | A | 12/1959 | Hellier et al. |
| 2,941,867 | A | 6/1960 | Maurer |
| 2,944,888 | A | 7/1960 | Quin |
| 3,058,820 | A | 10/1962 | Whitehurst |
| 3,067,025 | A | 12/1962 | Chrisholm |
| 3,085,871 | A | 4/1963 | Griffiths |
| 3,085,872 | A | 4/1963 | Kenneth |
| 3,113,017 | A | 12/1963 | Homme |
| 3,331,666 | A | 7/1967 | Robinson et al. |
| 3,379,522 | A | 4/1968 | Vordahl |
| 3,519,258 | A | 7/1970 | Ishizuka |
| 3,535,109 | A | 10/1970 | Ingersoll |
| 3,650,681 | A | 3/1972 | Sugahara et al. |
| 3,825,415 | A | 7/1974 | Johnston et al. |
| 3,836,302 | A | 9/1974 | Kaukeinen |
| 3,847,596 | A | 11/1974 | Holland et al. |
| 3,867,515 | A | 2/1975 | Bohl et al. |
| 3,919,087 | A | 11/1975 | Brumagim |
| 3,927,993 | A | 12/1975 | Griffin |
| 3,943,751 | A | 3/1976 | Akiyama et al. |
| 3,966,460 | A | 6/1976 | Spink |
| 4,007,055 | A | 2/1977 | Whittingham |
| 4,009,007 | A | 2/1977 | Fry |
| 4,017,302 | A | 4/1977 | Bates et al. |
| 4,070,252 | A | 1/1978 | Bonsack |
| 4,128,421 | A | 12/1978 | Marsh et al. |
| 4,141,719 | A | 2/1979 | Hakko |
| 4,149,876 | A | 4/1979 | Rerat |
| 4,190,442 | A | 2/1980 | Patel |
| 4,331,477 | A | 5/1982 | Kubo et al. |
| 4,379,718 | A | 4/1983 | Grantham et al. |
| 4,401,467 | A | 8/1983 | Jordan |
| 4,402,741 | A | 9/1983 | Pollet et al. |
| 4,414,188 | A | 11/1983 | Becker |
| 4,423,004 | A | 12/1983 | Ross |
| 4,425,217 | A | 1/1984 | Beer |
| 4,432,813 | A | 2/1984 | Williams |
| 4,445,931 | A | 5/1984 | Worthington |

(Continued)

FOREIGN PATENT DOCUMENTS

| | | |
|---|---|---|
| AU | 587782 | 11/1985 |
| AU | 2003263081 | 6/2004 |

(Continued)

OTHER PUBLICATIONS

Kelto et al. "Titanium Powder Metallurgy—A Perspective"; Conference: Powder Metallurgy of Titanium Alloys, Las Vegas, Nevada, Feb. 1980, pp. 1-19.

Mahajan et al, "Microstructure Property Correlation in Cold Pressed and Sintered Elemental Ti-6A 1-4V Powder Compacts"; Conference: Powder Metallurgv of Titanium Alloys, Las Vegas Nevada, Feb. 1980 pp. 189-202.

DeKock et al. "Attempted Preparation of Ti-6-4 Alloy Powders from $TiCl_4$, Al, $VCl_4$, and Na"; Metallurgical Transactions B, vol. 18B, No. 1, Process Metallurgy, Sep. 1987. pp. 511-517.

Upadhyaya "Metal Powder Compaction", Powder Metallurgy Technology, Published by Cambridge International Science Publishing, 1997, pp. 42-67.

Moxson et al. "Production and Applications of Low Cost Titanium Powder Products"; The International Journal of Powder Metallurgy, vol. 34, No. 5, 1998, pp. 45-47.

ALT "Solid-Liquid Separation, Introduction"; Ulmann's Encyclopedia of Industrial Chemistry, @2002 by Wiley-VCH Verlag GmbH & Co., Online Posting Date: Jun. 15, 2000, pp. 1-7.

(Continued)

*Primary Examiner* — George Wyszomierski
*Assistant Examiner* — Ngoclan T Mai
(74) *Attorney, Agent, or Firm* — Dunlap Codding, P.C.

(57) ABSTRACT

A titanium metal or a titanium alloy having submicron titanium boride substantially uniformly dispersed therein and a method of making same is disclosed. Ti power of Ti alloy powder has dispersed within the particles forming the powder titanum boride which is other than whisker-shaped or spherical substantially uniformly dispersed therein.

21 Claims, 8 Drawing Sheets

(56) References Cited

U.S. PATENT DOCUMENTS

| | | | |
|---|---|---|---|
| 4,454,169 | A | 6/1984 | Hinden et al. |
| 4,518,426 | A | 5/1985 | Murphy |
| 4,519,837 | A | 5/1985 | Down |
| 4,521,281 | A | 6/1985 | Kadija |
| 4,555,268 | A | 11/1985 | Getz |
| 4,556,420 | A | 12/1985 | Evans et al. |
| 4,604,368 | A | 8/1986 | Reeve |
| 4,606,902 | A | 8/1986 | Ritter |
| RE32,260 | E | 10/1986 | Fry |
| 4,687,632 | A | 8/1987 | Hurd et al. |
| 4,689,129 | A | 8/1987 | Knudsen |
| 4,725,312 | A | 2/1988 | Seon et al. |
| 4,828,008 | A | 5/1989 | White et al. |
| 4,830,665 | A | 5/1989 | Winand |
| 4,839,120 | A | 6/1989 | Baba et al. |
| 4,877,445 | A | 10/1989 | Okudaira et al. |
| 4,897,116 | A | 1/1990 | Scheel |
| 4,902,341 | A | 2/1990 | Okudaira et al. |
| 4,915,729 | A | 4/1990 | Boswell et al. |
| 4,915,905 | A | 4/1990 | Kampe et al. |
| 4,923,577 | A | 5/1990 | McLaughlin et al. |
| 4,940,490 | A | 7/1990 | Fife et al. |
| 4,941,646 | A | 7/1990 | Stelts et al. |
| 4,985,069 | A | 1/1991 | Traut |
| 5,028,491 | A | 7/1991 | Huang et al. |
| 5,032,176 | A | 7/1991 | Kametani et al. |
| 5,055,280 | A | 10/1991 | Nakatani et al. |
| 5,064,463 | A | 11/1991 | Ciomek |
| 5,082,491 | A | 1/1992 | Rerat |
| 5,147,451 | A | 9/1992 | Leland |
| 5,149,497 | A | 9/1992 | McKee et al. |
| 5,160,428 | A | 11/1992 | Kuri |
| 5,164,346 | A | 11/1992 | Giunchi et al. |
| 5,167,271 | A | 12/1992 | Lange et al. |
| 5,176,741 | A | 1/1993 | Bartlett et al. |
| 5,176,810 | A | 1/1993 | Volotinen et al. |
| 5,211,741 | A | 5/1993 | Fife |
| 5,259,862 | A | 11/1993 | White et al. |
| 5,338,379 | A | 8/1994 | Kelly |
| 5,356,120 | A | 10/1994 | König et al. |
| 5,427,602 | A | 6/1995 | DeYoung et al. |
| 5,437,854 | A | 8/1995 | Walker et al. |
| 5,439,750 | A | 8/1995 | Ravenhall et al. |
| 5,448,447 | A | 9/1995 | Chang |
| 5,460,642 | A | 10/1995 | Leland |
| 5,498,446 | A | 3/1996 | Axelbaum et al. |
| 5,580,516 | A | 12/1996 | Kumar |
| H1642 | H | 4/1997 | Jenkins |
| 5,637,816 | A | 6/1997 | Schneibel |
| 5,779,761 | A | 7/1998 | Armstrong et al. |
| 5,897,830 | A | 4/1999 | Abkowitz et al. |
| 5,914,440 | A | 6/1999 | Celik et al. |
| 5,948,495 | A | 9/1999 | Stanish et al. |
| 5,951,822 | A | 9/1999 | Knapick et al. |
| 5,954,856 | A | 9/1999 | Pathare et al. |
| 5,958,106 | A | 9/1999 | Armstrong et al. |
| 5,986,877 | A | 11/1999 | Pathare et al. |
| 5,993,512 | A | 11/1999 | Pargeter et al. |
| 6,010,661 | A | 1/2000 | Abe et al. |
| 6,027,585 | A | 2/2000 | Patterson et al. |
| 6,040,975 | A | 3/2000 | Mimura |
| 6,099,664 | A | 8/2000 | Davies |
| 6,103,651 | A | 8/2000 | Leitzel |
| 6,136,062 | A | 10/2000 | Loffelholz et al. |
| 6,180,258 | B1 | 1/2001 | Klier |
| 6,193,779 | B1 | 2/2001 | Reichert et al. |
| 6,210,461 | B1 | 4/2001 | Elliott |
| 6,238,456 | B1 | 5/2001 | Wolf et al. |
| 6,309,570 | B1 | 10/2001 | Fellabaum |
| 6,309,595 | B1 | 10/2001 | Rosenberg et al. |
| 6,409,797 | B2 | 6/2002 | Armstrong et al. |
| 6,432,161 | B1 | 8/2002 | Oda et al. |
| 6,488,073 | B1 | 12/2002 | Blenkinsop et al. |
| 6,502,623 | B1 | 1/2003 | Schmitt |
| 6,602,482 | B2 | 8/2003 | Kohler et al. |
| 6,689,187 | B2 | 2/2004 | Oda |
| 6,727,005 | B2 | 4/2004 | Gimondo et al. |
| 6,745,930 | B2 | 6/2004 | Schmitt |
| 6,824,585 | B2 | 11/2004 | Joseph et al. |
| 6,861,038 | B2 | 3/2005 | Armstrong et al. |
| 6,884,522 | B2 | 4/2005 | Adams et al. |
| 6,902,601 | B2 | 6/2005 | Nie et al. |
| 6,921,510 | B2 | 7/2005 | Ott et al. |
| 6,955,703 | B2 | 10/2005 | Zhou et al. |
| 7,041,150 | B2 | 5/2006 | Armstrong et al. |
| 7,351,272 | B2 | 4/2008 | Armstrong et al. |
| 7,410,610 | B2 | 8/2008 | Woodfield et al. |
| 7,435,282 | B2 | 10/2008 | Armstrong et al. |
| 7,445,658 | B2 | 11/2008 | Armstrong et al. |
| 7,501,007 | B2 | 3/2009 | Anderson et al. |
| 7,501,089 | B2 | 3/2009 | Armstrong et al. |
| 7,531,021 | B2 * | 5/2009 | Woodfield et al. ..... 75/244 |
| 2002/0050185 | A1 | 5/2002 | Oda |
| 2002/0152844 | A1 | 10/2002 | Armstrong et al. |
| 2003/0061907 | A1 | 4/2003 | Armstrong et al. |
| 2003/0145682 | A1 | 8/2003 | Anderson et al. |
| 2003/0230170 | A1 | 12/2003 | Woodfield et al. |
| 2003/0231974 | A1 | 12/2003 | Woodfield et al. |
| 2004/0123700 | A1 | 7/2004 | Zhou et al. |
| 2004/0141869 | A1 | 7/2004 | Ott et al. |
| 2004/0208773 | A1 | 10/2004 | Woodfield et al. |
| 2005/0081682 | A1 | 4/2005 | Armstrong et al. |
| 2005/0150576 | A1 | 7/2005 | Venigalla |
| 2005/0225014 | A1 | 10/2005 | Armstrong et al. |
| 2005/0284824 | A1 | 12/2005 | Anderson et al. |
| 2006/0057017 | A1 | 3/2006 | Woodfield |
| 2006/0086435 | A1 | 4/2006 | Anderson et al. |
| 2006/0102255 | A1 | 5/2006 | Woodfield et al. |
| 2006/0107790 | A1 | 5/2006 | Anderson et al. |
| 2006/0123950 | A1 | 6/2006 | Anderson et al. |
| 2006/0150769 | A1 | 7/2006 | Armstrong et al. |
| 2006/0230878 | A1 | 10/2006 | Anderson et al. |
| 2007/0017319 | A1 | 1/2007 | Jacobsen et al. |
| 2007/0079908 | A1 | 4/2007 | Jacobsen et al. |
| 2007/0180951 | A1 | 8/2007 | Armstrong et al. |
| 2007/0180952 | A1 | 8/2007 | Lanin et al. |
| 2008/0031766 | A1 | 2/2008 | Kogut et al. |
| 2008/0152533 | A1 | 6/2008 | Ernst et al. |
| 2008/0187455 | A1 | 8/2008 | Armstrong et al. |
| 2008/0199348 | A1 | 8/2008 | Armstrong et al. |

FOREIGN PATENT DOCUMENTS

| | | |
|---|---|---|
| CA | 2196534 | 2/1996 |
| EA | 006615 | 2/2006 |
| EA | 007634 | 12/2006 |
| EP | 0298698 | 1/1989 |
| EP | 0299791 | 1/1989 |
| EP | 1441039 | 7/2004 |
| EP | 1657317 | 5/2006 |
| GB | 722184 | 1/1955 |
| GB | 778021 | 7/1957 |
| JP | 31007808 | 9/1956 |
| JP | 49042518 | 4/1974 |
| JP | 51010803 | 4/1976 |
| JP | 60255300 | 12/1985 |
| JP | 6112837 | 1/1986 |
| JP | 62065921 | 3/1987 |
| JP | 64047823 | 2/1989 |
| JP | 4116161 | 4/1992 |
| JP | 05078762 | 3/1993 |
| JP | 10502418 | 3/1998 |
| JP | 11090692 | 4/1999 |
| JP | 2001279345 | 10/2001 |
| NO | 90840 | 1/1958 |
| RU | 411962 | 1/1974 |
| WO | WO96/04407 | 2/1996 |
| WO | WO98/24575 | 6/1998 |
| WO | WO03/106080 | 12/2003 |
| WO | WO2004/022269 | 3/2004 |
| WO | WO2004/022797 | 3/2004 |
| WO | WO2004/022798 | 3/2004 |
| WO | WO2004/022799 | 3/2004 |
| WO | WO2004/022800 | 3/2004 |

(56) References Cited

FOREIGN PATENT DOCUMENTS

| | | |
|---|---|---|
| WO | WO2004/026511 | 4/2004 |
| WO | WO2004/028655 | 4/2004 |
| WO | WO2004/033736 | 4/2004 |
| WO | WO2004/033737 | 4/2004 |
| WO | WO2004/048622 | 10/2004 |
| WO | WO2005/019485 | 3/2005 |
| WO | WO2005/021807 | 3/2005 |
| WO | WO2005/023725 | 3/2005 |
| WO | WO2005/042792 | 5/2005 |
| WO | WO2007/044635 | 4/2007 |
| WO | WO2007/089400 | 8/2007 |
| WO | WO2008/013518 | 1/2008 |
| WO | WO2008/079115 | 7/2008 |

OTHER PUBLICATIONS

Gerdemann et al, "Characterization of a Titanium Powder Produced Through a Novel Continuous Process"; Published by Metal Powder Industries Federation, 2000, pp. 12.41-12.52.

Moxson et al. "Innovations in Titanium Powder Processing"; Titanium Overview, JOM, May 2000, p. 24.

Gerdemann "Titanium Process Technologies"; Advanced Materials & Processes, Jul. 2001, pp. 41-43.

Lü et al. "Laser-Induced Materials and Processes for Rapid Prototyping" Published by Springer 2001, pp. 153-154.

Lee et al. "Synthesis of Nano-Structured Titanium Carbide by Mg-Thermal Reduction"; Scripta Materialia, 2003, pp. 1513-1518.

Chandran et al. "$TiB_w$-Reinforced Ti Composites: Processing, Properties, Application Prospects, and Research Needs"; Ti—B Alloys and Composites Overview, JOM, May 2004, pp. 42-48.

Chandran et al. Titanium—Boron Alloys and Composites: Processing, Properties, and Applications•; Ti—B Alloys and Composites Commentary, JOM, May 2004, pp. 32 and 41.

Hanusiak et al. "The Prospects for Hybrid Fiber-Reinforced Ti—TiB-Matrix Composites"; Ti—B Alloys and Composites Overview, JOM, May 2004, pp. 49-50.

Kumari et al. "High-Temperature Deformation Behavior of Ti—$TiB_w$ In-Situ Metal-Matrix composites"; Ti—B Alloys and Composites Research Summary, JOM, May 2004, pp. 51-55.

Saito "The Automotive Application of Discontinuously Reinforced TiB—Ti Composites"; Ti—B Alloys and Composites Overview, JOM. May 2004, pp. 33-36.

Yolton "The Pre-Alloyed Powder Metallurgy of Titanium with Boron and Carbon Additions"; Ti—B Alloys and Composites Research Summary, JOM, May 2004, pp. 56-59.

Woodfield et al., "Prospects for a New Generation of Titanium Alloys and Structures," AeroMat 2005, Jun. 2005, 30 pp. (1 p. of Abstract and 29 pgs. ppt).

Research Report; P/M Technology News, Crucible Research, Aug. 2005, vol. 1, Issue 2, 2 pages.

AU Patent Application No. 2006302273—Opposition filed by Christopher Carter Feb. 18, 2011.

AU Patent Application No. 2006302273—Amendment and Statuary Declaration in Response to Opposition, filed Jan. 29, 2013.

* cited by examiner

Width(μm): 2600.44 Height(μm): 1950.33 μm/pixel: 1.270

Scope magnification: 50X

Width(μm): 2600.44 Height(μm): 1950.33 μm/pixel: 2.539

Scope magnification: 50X

Width(μm): 48.00 Height(μm): 36.00 μm/pixel: 0.023

Scope magnification: 3000X

Width(μm): 48.00 Height(μm): 36.00 μm/pixel: 0.047

Scope magnification: 3000X

Width(μm): 3164.83 Height(μm): 2373.63 μm/pixel: 6.181

Scope magnification: 40X

Width(μm): 2600.44 Height(μm): 1950.33 μm/pixel: 2.539

Scope magnification: 50X

Width(μm): 48.00 Height(μm): 36.00 μm/pixel: 0.094

Scope magnification: 3000X

Width(μm): 48.00 Height(μm): 36.00 μm/pixel: 0.047

Scope magnification: 3000X

TITANIUM BORIDE

This application is a continuation of U.S. Ser. No. 11/544,820, filed on Oct. 6, 2006, now abandoned, which, pursuant to 37 C.F.R. 1.78(c), claims priority based on provisional application Ser. No. 60/724,166 filed Oct. 6, 2005. Each cited application is expressly incorporated by reference herein in its entirety.

BACKGROUND OF THE INVENTION

Relatively small boron additions to conventional titanium alloys provide important improvements in strength, stiffness and microstructural stability. Because boron is essentially insoluble in titanium at all temperatures of interest, the titanium boride is formed for even very small boron additions. The density of titanium boride is nearly equal to those of conventional Ti alloys, but its stiffness is over four times higher than conventional titanium alloys. Thus, titanium boride offers significant improvements in stiffness, tensile strength, creep, and fatigue properties. Since titanium boride is in thermodynamic equilibrium with titanium alloys, there are no interfacial reactions to degrade properties at elevated temperature. Further, because the coefficient of thermal expansion of titanium boride is nearly equal to values for titanium alloys, residual stresses are nearly eliminated" Taken from JOM Article May 2004 "Powder Metallurgy Ti-6Al-4V Alloys: Processing, Microstructure, and Properties", the entire disclosure of which is incorporated by reference.

Currently two approaches appear to be used to accomplish boron addition; 1) Blended elemental addition of $TiB_2$ and solid state reaction to produce the titanium boride which usually forms as whiskers with a 10 to 1 aspect ratio and 2) Pre-alloyed powders from a melt process.

Negatives of the blended elemental approach are the added effort to blend the powders to obtain a uniform distribution (which is never perfect) and the added time and temperature it takes the solid state reaction to transform $TiB_2$ to TiB (1300 C for 6 hours). Also, this approach has the potential to form larger Titanium boride particles or have residual titanium boride particles that adversely affect properties. The titanium boride whiskers that are formed can lead to anisotropic properties of the part depending on the type of process used to make the part.

A negative of the pre-alloyed approach is that it has a tendency to leave large primary borides in the pre-alloyed materials that cause low fracture toughness.

Representative examples of patents related to producing metal alloys with titanium boride are the Davies et al. U.S. Pat. No. 6,099,664 issued to Davies et al. Aug. 8, 2000, in which titanium boride particles in the 1-10 micron size range are produced in a molten reaction zone. The Blenkinsop et al. U.S. Pat. No. 6,488,073 issued Dec. 3, 2002 teaches the addition of an alloy in which tantalum boride or tungsten boride particles are added to a molten alloy material to form a molten mixture which upon cooling has the boride distributed therein. Another method of making boride containing titanium alloys is disclosed in the Abkowitz U.S. Pat. No. 5,897,830 in which titanium boride powders are mixed with the powders of various constituents to form a consumable billet which is thereafter cast or melted to form the article of manufacture. Each of these processes as described in the above-mentioned patents has a variety of shortcomings, not the least of which is the imperfect distribution of the boride as well as the size of the boride particles.

SUMMARY OF THE INVENTION

The Armstrong Process as disclosed in U.S. Pat. Nos. 5,779,761, 5,958,106 and 6,409,797, the entire disclosures of which are herein incorporated by reference appears very unexpectedly to give uniform distribution of very fine submicron titanium boride within the Ti or Ti alloy powder. This eliminates the need for blending and solid state reaction to form titanium boride; it also eliminates concerns regarding larger particles that can adversely affect fracture toughness and other mechanical properties. Because of the fineness of the titanium boride particles and the uniform distribution in most if not substantially all of the particles forming the powder, more isotropic mechanical properties may be achievable. None of the current approaches to boron addition to Ti powder can achieve this type of distribution of titanium boride, particularly in the submicron size ranges.

Accordingly, it is a principal object of the present invention to provide a titanium metal or a titanium alloy having submicron titanium boride substantially uniformly dispersed therein.

Another object of the invention is to provide a Ti powder or a Ti base alloy powder having submicron titanium boride substantially uniformly dispersed therein, wherein the Ti powder or Ti base alloy powder and titanium boride are made by the subsurface reduction of $TiCl_4$ and a boron halide and other chlorides and/or halides of the Ti base alloy constituents, if present, with liquid alkali or alkaline earth metal or mixtures thereof in a reaction zone.

A further object of the invention is to provide a Ti powder or a Ti base alloy powder having submicron titanium boride which is other than whisker-shaped or spherical substantially uniformly dispersed therein.

A final object of the invention is to provide a product having an SEM substantially as shown in one or more of FIGS. 1-8.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
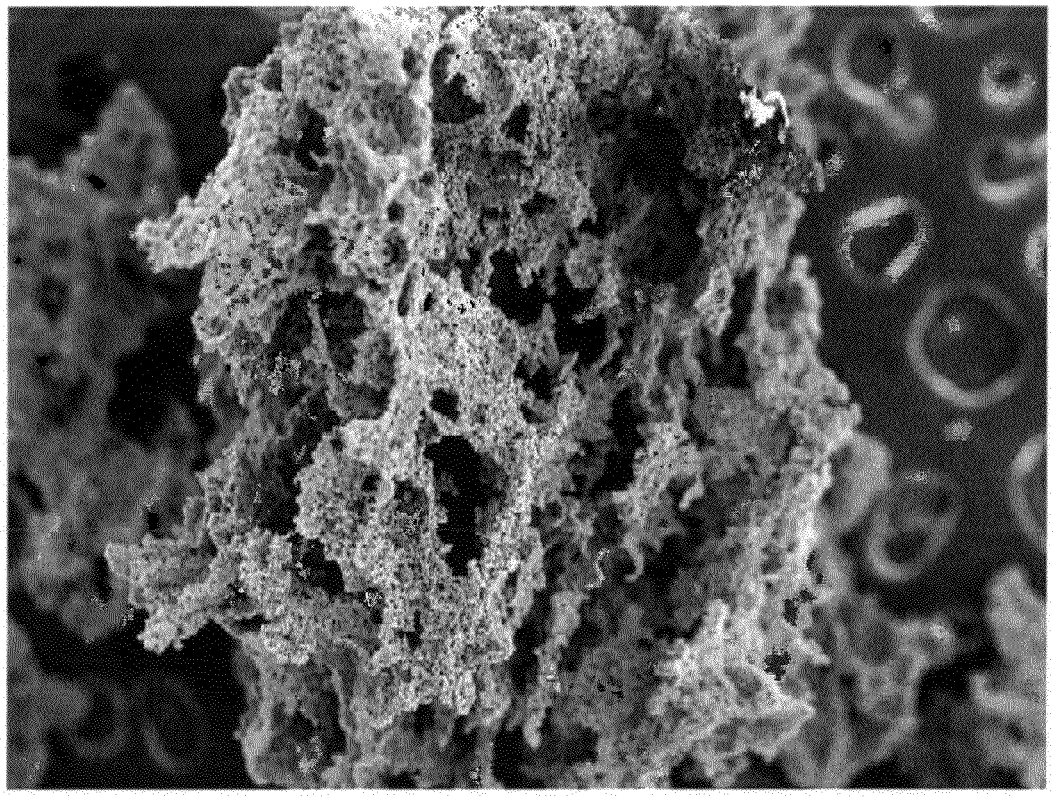
FIG. 1 is an SEM of a titanium powder having submicron titanium boride substantially uniformly dispersed therethrough at a magnification of 50.

Using the Armstrong method described in the above three identified patents and application Ser. No. 11/186,724 filed Jul. 21, 2005, the entire application is herein incorporated by reference.

The equipment used to produce the 6/4 alloy with submicron titanium boride substantially uniformly dispersed therein is similar to that disclosed in the aforementioned patents disclosing the Armstrong Process with the exception that instead of only having a titanium tetrachloride boiler 22 as illustrated in those patents, there is also a boiler for each constituent of the alloy connected to the reaction chamber by suitable valves. Boron addition is from a boiler for $BCl_3$. The piping acts as a manifold so that the gases are completely mixed as they enter the reaction chamber and are introduced subsurface to the flowing liquid sodium, preferably at least at sonic velocity, as disclosed in the incorporated patents. Upon subsurface contact with the liquid metal the halides immediately and completely react exothermically to form a reaction zone in which the reaction products are produced. The flowing liquid metal preferably sodium, sweeps the reaction products away from the reaction zone maintaining the reaction products at a temperature below the sintering temperatures of the reaction products. It was determined during production of the 6/4 alloy that aluminum trichloride is corrosive and required special materials not required for handling either titanium tetrachloride or vanadium tetrachloride. Therefore, Hastelloy C-276 was used for the aluminum trichloride boiler and the piping to the reaction chamber. The $BCl_3$ is not as corrosive as $AlCl_3$.

During most of the runs the steady state temperature of the reactor was maintained at about 400° C. by the use of sufficient excess sodium. Other operating conditions for the production of the 6/4 alloy powder with submicron titanium boride dispersed in most, if not substantially all, of the particles forming the powder were as follows:

A device similar to that described in the incorporated Armstrong patents was used except that a $VCl_4$ boiler, a $AlCl_3$ boiler and a $BCl_3$ boiler were provided and all three gases were fed into the line feeding $TiCl_4$ into the liquid Na. The typical boiler pressures and system parameters are listed hereafter in Table 1.

TABLE 1

| Run# | Boron Wt % | Aluminum Wt % | Vanadium Wt % | Oxygen Wt % | TiCl4 Noz. Dia. (in) | TiCl4 Press. (Kpa) | TiCl4 Flow (Kg/min) | VCl4 Press. (Kpa) | AlCl3 Press. (Kpa) | Boron Noz. Dia. (in) | Boron Press. (Kpa) | Distill Temp (C.) | Bake Temp(C.)/ Time (hrs) |
|---|---|---|---|---|---|---|---|---|---|---|---|---|---|
| NR285 | .82 | — | — | .485 | 7/32 | 540 | 2.4 | — | — | .040 | 640 | 575 | 750/24 |
| | .89 | | | .477 | | | | | | | | | |
| | .9 | | | .605 | | | | | | | | | |
| | .82 | | | .578 | | | | | | | | | |
| NR286 | 2.21 | — | — | .874 | 7/32 | 500 | 2.3 | — | — | .040 | 1400-1600 | 575 | 775/24 |
| | 3.17 | | | .875 | | | | | | | | | |
| | 3.15 | | | .985 | | | | | | | | | |
| | 3.18 | | | .969 | | | | | | | | | |
| NR291 | .25 | 7.08 | 2.84 | .346 | 7/32 | 500 | 2.9 | 640 | 860 | .040 | 600 | 575 | 775/24 |
| | .38 | 6.91 | 2.5 | .494 | | | | | | | | | |
| NR292 | 2.58 | 7.46 | 3.79 | 1.06 | 7/32 | 510 | 2.2 | 620 | 850 | .040 | 1500 | 575 | 775/24 |
| | 2.49 | 7.72 | 3.59 | 1.33 | | | | | | | | | |
| A-308 | .71 | — | — | .304 | 7/32 | 500 | 2.5 | — | — | .040 | 450-525 | 575 | 790/30 |
| | .64 | | | .303 | | | | | | | | | |
| A-328 | 1.24 | — | — | .31 | 5/32 | 550 | 1.23 | — | — | .040 | 570 | 575 | 790/36 |

Inlet Na temperature about 240° C.
Reactor Outlet Temperature about 510° C.
Na Flowrate about 40 kg/min The reactor was generally operated for approximately 250 seconds injecting approximately 11 kg of $TiCl_4$. The salt and titanium alloy solids were captured on a wedge wire filter and free sodium metal was drained away. The product cake containing titanium alloy, sodium chloride and sodium was distilled at approximately 100 milli-torr at 550 to 575° C. vessel wall temperatures for 20 hours. Once all the sodium metal was removed via distillation, the trap was re-pressurized with argon gas and heated to 750° C. and held at temperature for 48 hours. The vessel containing the salt and titanium alloy cake was cooled and the cake was passivated with a 0.7 wt % oxygen/argon mixture. After passivation, the cake was washed with deionized water and subsequently dried in a vacuum oven at less than 100° C.

Table 2 below sets forth a chemical analysis of various runs for both Ti as well as 6/4 alloy with submicron titanium boride substantially uniformly dispersed therein from an experimental loop running the Armstrong Process. As used herein, titanium boride means principally TiB but does not exclude minor amounts of $TiB_2$ or other borides.

Similarly, the process described herein produces a novel powder in which most, if not substantially all, of the particles forming the powder have submicron titanium boride dispersed therein. While the boride dispersion may not always be perfect in every particle, the titanium boride is very small, submicron, and generally uniformly dispersed within the particles forming the powder, whether the powder is titanium or a titanium alloy.

As seen from Table 2 below, the sodium levels for 6/4 with submicron titanium boride are very low while the sodium level for Ti with submicron titanium boride are somewhat higher, but still less than commercially pure titanium, without submicron titanium boride dispersed therein, made by the Armstrong Process, as described in the incorporated application.

As stated in the referenced application, the surface area of the 6/4 alloy compared to the CP titanium, as determined using BET Specific Surface Area analysis with krypton as the adsorbate is much larger than the CP titanium. The surface area of the 6/4 alloy with titanium boride is even greater, that is the alloy powder with titanium boride was smaller in average diameter and more difficult to grow into larger particles than Ti alloy without titanium boride.

TABLE 2

| Al % by weight | V % by weight | B % by weight | Na |
|---|---|---|---|
| 9 | 5 | | 0.0039 |
| 10 | 5 | | 0.0026 |
| 8 | 5 | | 0.001 |
| 7 | 2.2 | | 0.017 |
| 8 | 1.8 | | 0.0086 |
| 5.4 | 5.3 | | 0.0015 |
| 7.3 | 4.7 | | 0.002 |
| 14 | 3 | | 0.018 |
| 7.75 | 5.2 | | 0.009 |
| 9.6 | 6.8 | | 0.0078 |
| 13 | 6.7 | | 0.0092 |
| 9.2 | 0.009 | | 0.014 |
| 6 | 4 | | 0.0018 |
| 5.7 | 3.5 | | 0.0018 |
| 5 | 2.2 | | 0.0018 |
| 5.3 | 3.6 | | 0.0052 |
| 7.2 | 4 | | 0.014 |
| | | 0.82 | 0.018 |
| | | 0.89 | 0.023 |
| | | 0.9 | 0.0047 |
| | | 0.82 | 0.0028 |
| | | 2.21 | 0.0047 |
| | | 3.17 | 0.0076 |
| | | 3.15 | 0.013 |
| | | 3.2 | 0.012 |
| 7.08 | 2.84 | 0.25 | 0.0025 |
| 6.91 | 2.5 | 0.38 | 0.0024 |
| 7.46 | 3.79 | 2.58 | 0.0023 |
| 7.72 | 3.59 | 2.49 | 0.0077 |

Figure 2:
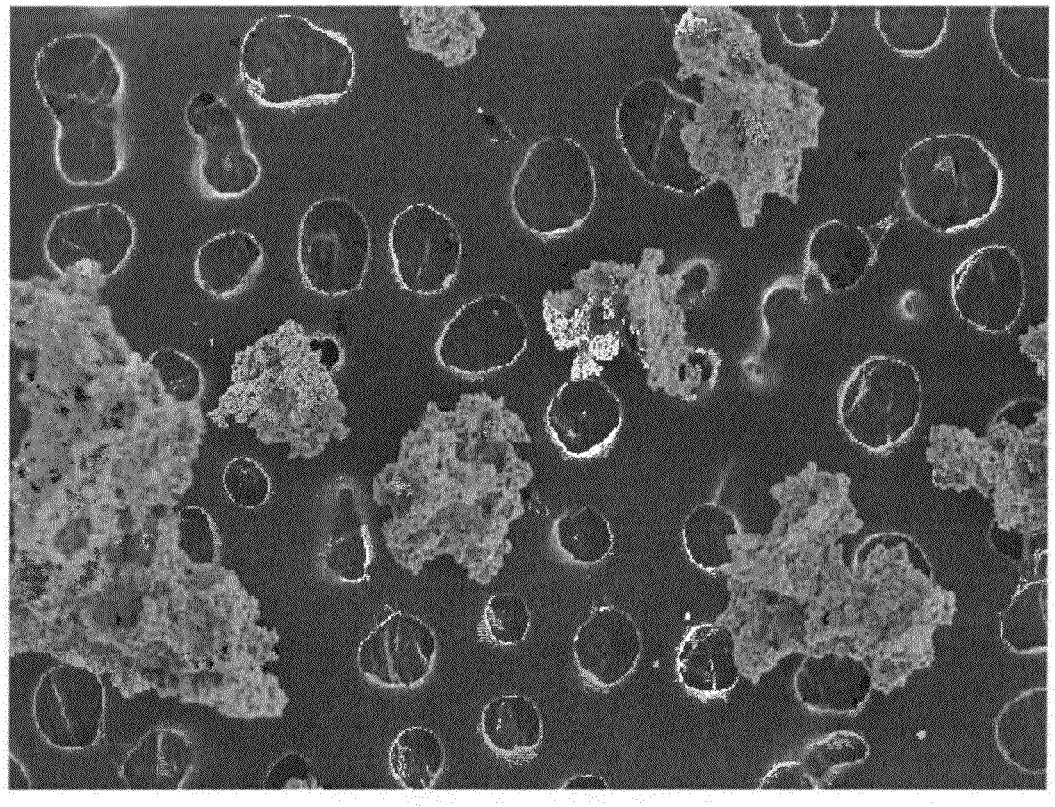
FIG. 2 is another SEM of a titanium powder having submicron titanium boride substantially uniformly dispersed therethrough at a magnification of 50.
Figure 3:
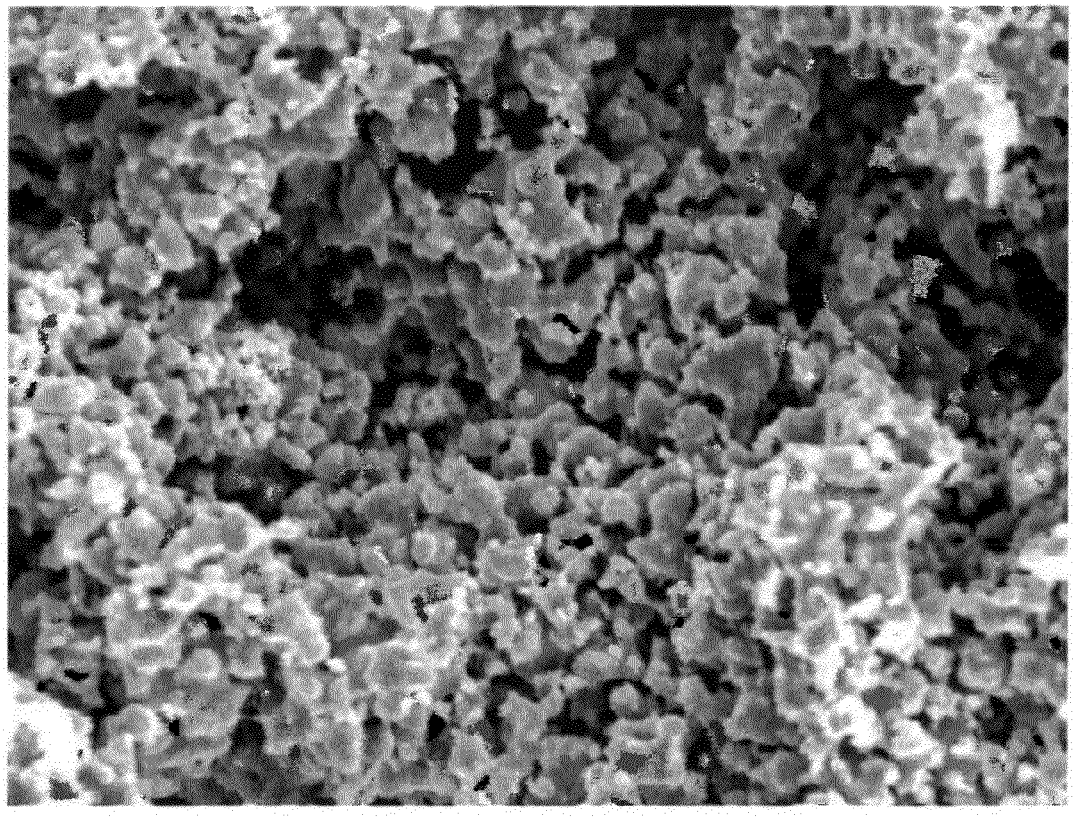
FIG. 3 is a similar SEM of a titanium powder having submicron titanium boride substantially uniformly dispersed therethrough at a magnification of 3000.
Figure 4:
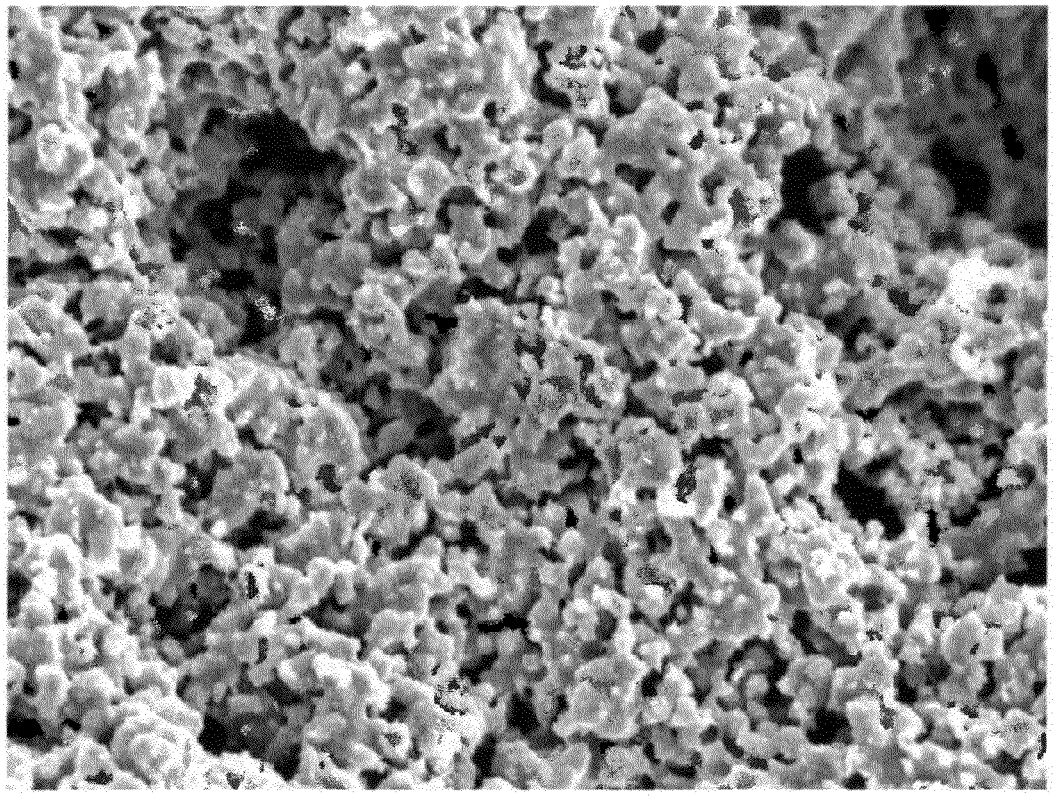
FIG. 4 is another SEM of a titanium powder having submicron titanium boride substantially uniformly dispersed therethrough at a magnification of 3000.
Figure 5:
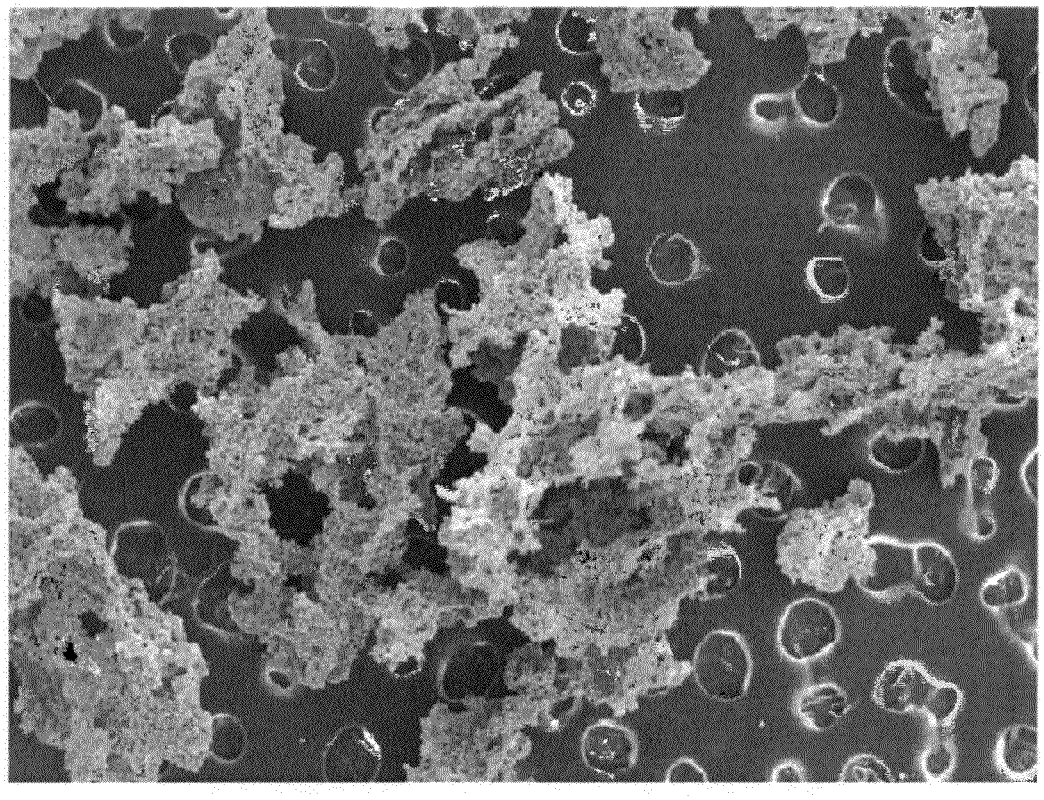
FIG. 5 is a titanium base alloy having about 10% total of aluminum and vanadium with titanium boride with submicron titanium borides substantially uniformly dispersed throughout the particles forming the powder at a 40 magnification.
Figure 6:
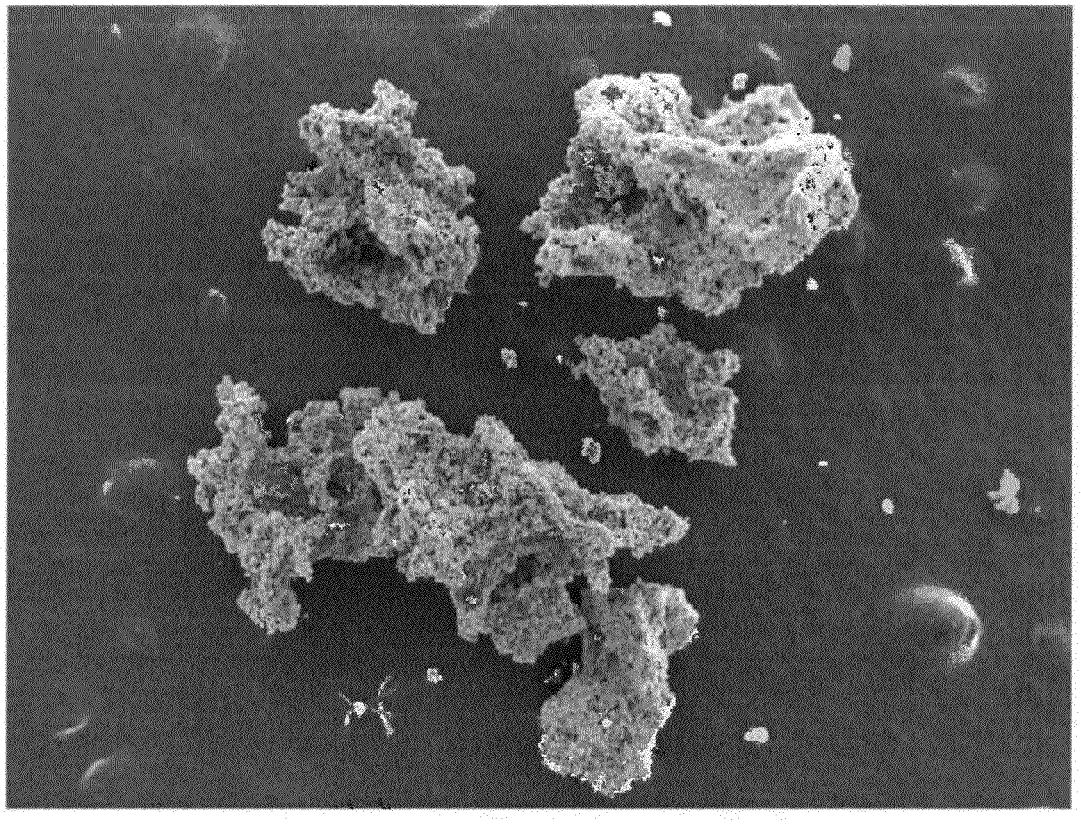
FIG. 6 is a titanium base alloy having about 10% total of aluminum and vanadium with titanium boride with submicron titanium borides substantially uniformly dispersed throughout the particles forming the powder at a 50 magnification.
Figure 7:
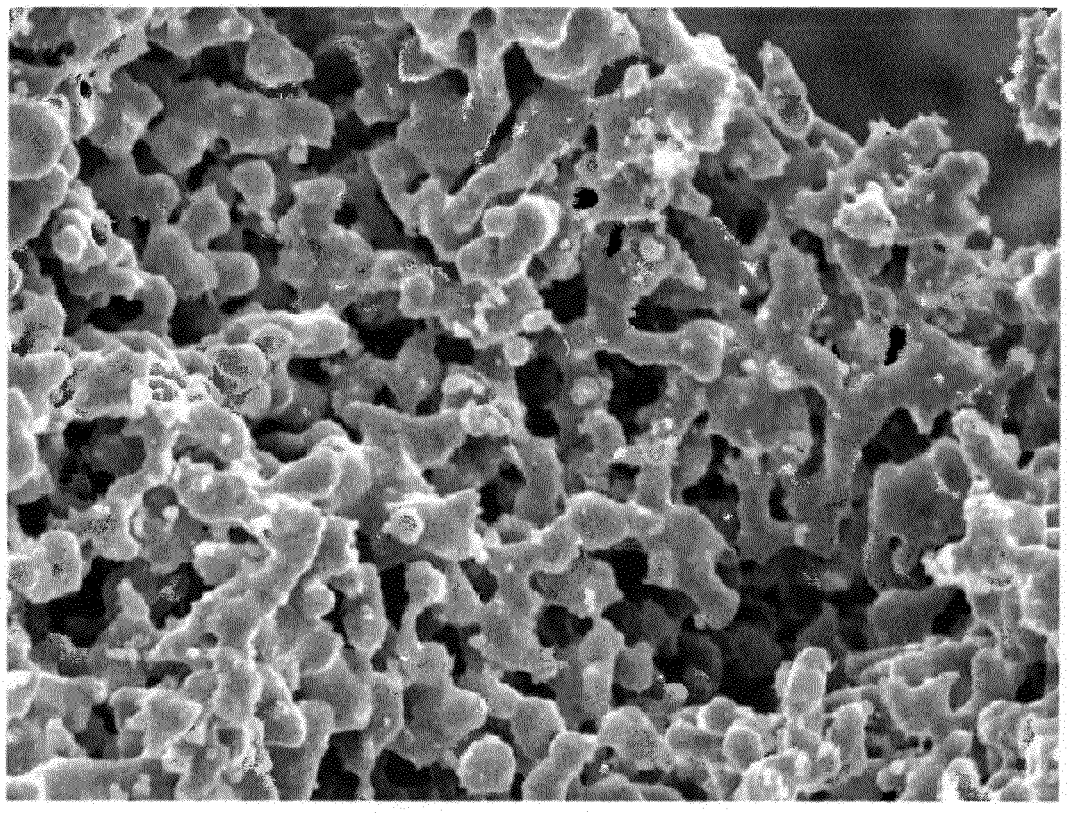
FIG. 7 is a titanium base alloy having about 10% total of aluminum and vanadium with titanium boride with submicron titanium borides substantially uniformly dispersed throughout the particles forming the powder at a 3000 magnification.
Figure 8:
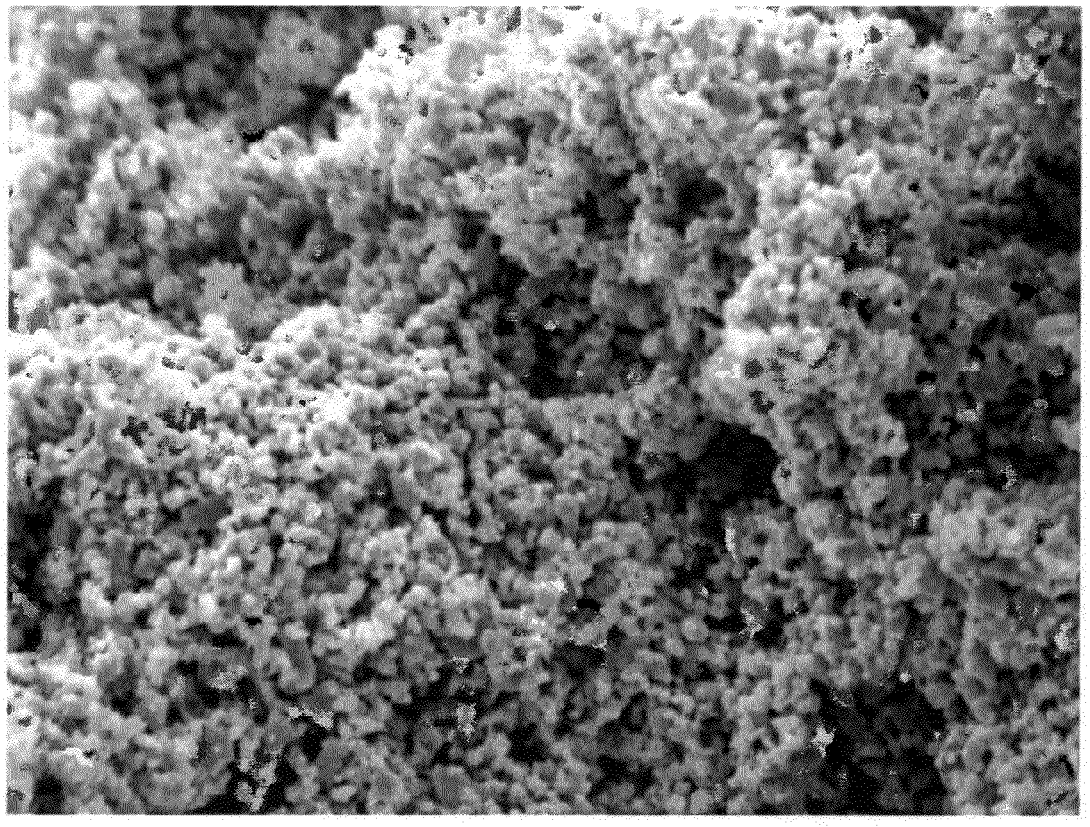
FIG. 8 is a titanium base alloy having about 10% total of aluminum and vanadium with titanium boride with submicron titanium borides substantially uniformly dispersed throughout the particles forming the powder at a 3000 magnification (a different portion of the same sample as FIG. 7).

The SEMs of FIGS. 1-8 show that the 6/4 powder and/or Ti powder with submicron titanium boride distributed therein is "frillier" than the previously made 6/4 powder in the referenced application. Each of the figures references a run disclosed in Table 1 and represents samples taken from that run at different magnifications. As stated in the referenced application and as reported by Moxson et al., *Innovations in Titanium Powder Processing* in the Journal of Metallurgy May 2000, it is clear that by-product fines from the Kroll or Hunter Processes contain large amounts of undesirable chlorine which is not present in the CP titanium powder or alloy made by the Armstrong Process. Moreover, the morphology of the Hunter and Kroll fines, as previously discussed, is different from the CP powder or the 6/4 alloy powder or either with submicron titanium boride therein made by the Armstrong Process. Neither the Kroll nor the Hunter process has been adapted to produce 6/4 alloy or any alloy. Alloy powders have been produced by melting prealloyed stock and thereafter using either gas atomization or a hydride-dehydride process (MHR). The Moxson et al. article discloses 6/4 powder made in Tula, Russia and as seen from FIG. 2 in that article, particularly FIGS. 2c and 2d the powders made by Tula Hydride Reduction process are significantly different than those made by the Armstrong Process. Moreover, referring to the Moxson et al. article in the 1998 issue of the International Journal of Powder Metallurgy, Vol. 4, No. 5, pages 45-47, it is seen that the chemical analysis for the pre-alloy 6/4 powder produced by the metal-hydride reduction (MHD) process contains exceptional amounts of calcium and also is not within ASTM specifications for aluminum.

As is well known in the art, solid objects can be made by forming 6/4 or CP titanium powders into a near net shapes and thereafter sintering, see the Moxson et al. article and can also be formed by hot isostatic pressing, laser deposition, metal injecting molding, direct powder rolling or various other well known techniques. Therefore, the titanium alloy powder or titanium powder with submicron titanium boride dispersed substantially uniformly therein made by the Armstrong method may be formed into a consolidated or a consolidated and sintered product or may be formed into a solid object by well known methods in the art and the subject invention is intended to cover all such products made from the powder of the subject invention.

There has been disclosed herein a titanium metal powder or a titanium base alloy powder having submicron titanium boride substantially uniformly dispersed therein.

The specific titanium alloy of the type set forth wherein Al and V are present in a minor amount by weight, but preferably ASTM Grade 5, as well as commercially pure titanium, ASTM Grade 2, both as disclosed in the incorporated patent application, Table 1 therein, with submicron titanium boride substantially uniformly dispersed therein have been disclosed, wherein boron is present up to about 4% by weight. The invention however, includes any weight of boron added. Preferably, alloys have at least 50% by weight titanium with titanium boride, preferably TiB, present in any required amount.

Any halide may be used in the process, as previously described, but chlorides are preferred because they are readily available and less expensive than other halides. Various alkali or alkaline earth metals may be used, i.e. Na, K, Mg, Ca, but Na is preferred.

Solid products are routinely made by a variety of processes from the powders described herein. Products made from powder produced by the Armstrong method including $BCl_3$ introduced into flowing liquid reducing metal prod uce superior hardness and other desirable physical properties are within the scope of this invention.

While the invention has been particularly shown and described with reference to a preferred embodiment thereof, it will be understood by those skilled in the art that several changes in form and detail may be made without departing from the spirit and scope of the invention.

What is claimed is:

1. A method of forming a titanium metal powder, the method comprising:

subsurfacely introducing a vapor mixture of titanium tetrachloride and a boron halide into a flowing stream of a liquid metal comprising an alkali metal, an alkaline earth metal, or a mixture thereof, to produce the reaction products comprising titanium metal powder having submicron titanium boride substantially uniformly dispersed therein, wherein the liquid metal is present in a sufficient amount to (i) reduce the vapor mixture to form the reaction products, and (ii) maintain the reaction products below a sintering temperature of the titanium metal powder; and recovering the titanium metal powder from the reaction products.

2. The method of claim 1 wherein the titanium metal powder comprises boron in an amount greater than 0% by weight up to 3.2% by weight of the titanium metal powder.

3. The method of claim 1 wherein the titanium metal powder comprises boron in an amount greater than 0% by weight up to about 4% by weight of the titanium metal powder.

4. The method of claim 1, wherein the titanium boride is other than whisker-shaped or spherical shaped.

5. The method of claim 1, further comprising forming the titanium metal powder into a consolidated powder.

6. The method of claim 1, further comprising sintering the titanium metal powder to form a sintered powder.

7. The method of claim 1, wherein the titanium boride is principally in the form of TiB.

8. The method of claim 1, wherein the alkali metal is at least one of sodium and potassium.

9. The method of claim 1, wherein the alkaline earth metal is at least one of magnesium or calcium.

10. The method of claim 1, wherein the vapor mixture is introduced into the flowing stream of liquid metal at at least sonic velocity.

11. The method of claim 1, wherein the boron halide substantially comprises $BCl_3$.

12. The method of claim 1, wherein at least half of the particles forming the titanium metal powder contain titanium boride.

13. The method of claim 1, wherein the titanium boride is dispersed within substantially all of the particles of the titanium metal powder.

14. The method of claim 1, further comprising subsurfacely introducing at least one of Al and V to form a titanium alloy of at least one of Al and V.

15. The method of claim 1, comprising the step of consolidating the titanium metal powder into a solid object.

16. A method of forming a titanium metal powder, the method comprising:

subsurfacely introducing a vapor mixture of titanium tetrachloride and a boron halide into a flowing stream of a liquid metal comprising an alkali metal, an alkaline earth metal, or a mixture thereof, to produce the reaction products comprising titanium metal powder having submicron titanium boride substantially uniformly dispersed therein, wherein the titanium metal powder comprises boron in an amount greater than 0% by weight up to about 4% by weight of the titanium metal powder, and wherein the liquid metal is present in a sufficient amount to (i) reduce the vapor mixture to form the reaction products, and (ii) maintain the reaction products below a sintering temperature of the titanium metal powder; and recovering the titanium metal powder from the reaction products.

17. The method of claim 16 wherein the titanium metal powder comprises boron in an amount greater than 0% by weight up to 3.2% by weight of the titanium metal powder.

18. The method of claim 16, wherein the titanium boride is other than whisker-shaped or spherical shaped.

19. The method of claim 16, wherein the titanium boride is principally in the form of TiB.

20. The method of claim 16, wherein the boron halide substantially comprises $BCl_3$.

21. The method of claim 16, further comprising subsurfacely introducing at least one of Al and V to form a titanium alloy of at least one of Al and V.

* * * * *